US009552679B2

(12) United States Patent
Rutkowski et al.

(10) Patent No.: US 9,552,679 B2
(45) Date of Patent: Jan. 24, 2017

(54) SYSTEM AND METHOD FOR VEHICLE DAMPER MONITORING

(71) Applicant: FORD GLOBAL TECHNOLOGIES, LLC, Dearborn, MI (US)

(72) Inventors: David John Rutkowski, Grosse Ile, MI (US); Brian D. Rutkowski, Ypsilanti, MI (US); Russ Lee Norton, Brownstown Township, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 75 days.

(21) Appl. No.: 14/056,681

(22) Filed: Oct. 17, 2013

(65) Prior Publication Data

US 2015/0112540 A1 Apr. 23, 2015

(51) Int. Cl.
*G07C 5/00* (2006.01)

(52) U.S. Cl.
CPC ..... *G07C 5/006* (2013.01)

(58) Field of Classification Search
None
See application file for complete search history.

(56) References Cited

U.S. PATENT DOCUMENTS 4,600,215 A 7/1986 Kuroki et al.
4,634,143 A * 1/1987 Asami ..... B60G 17/0165 180/41
4,725,072 A 2/1988 Asami et al.
4,809,179 A * 2/1989 Klinger ..... B60G 17/0157 280/5.504
4,922,427 A * 5/1990 Yokote ..... B60G 17/016 180/422
5,124,917 A * 6/1992 Kanamori ..... B60G 17/018 280/5.519
5,430,647 A * 7/1995 Raad ..... B60G 17/016 180/41
5,891,278 A * 4/1999 Rivin ..... B60B 21/12 152/400
6,370,458 B1 * 4/2002 Shal ..... B60G 17/0162 180/41
7,328,659 B2 * 2/2008 Forbes ..... 105/198.2
2002/0104724 A1 * 8/2002 Reybrouck ..... F16F 9/36 188/313
2003/0030566 A1 * 2/2003 Schmidt ..... H03K 17/954 340/686.6

(Continued)

FOREIGN PATENT DOCUMENTS

DE 102006031587 A1 1/2008
EP 0220115 A1 4/1987
GB 2315051 A 1/1998

OTHER PUBLICATIONS

FSAE After Calculation Vehicle Tuning, Jim Kasprzak 2012.*

(Continued)

*Primary Examiner* — Rami Khatib
(74) *Attorney, Agent, or Firm* — Jones Robb, PLLC; Raymond L. Coppiellie

(57) ABSTRACT

A vehicle damper monitoring system of the present disclosure may include at least one height sensor and at least one controller configured to receive signals from the at least one height sensor and generate a notification if the signals indicate that one or more suspension dampers of a vehicle need to be serviced.

22 Claims, 6 Drawing Sheets

(56) References Cited

U.S. PATENT DOCUMENTS

| | | | | |
|---|---|---|---|---|
| 2006/0267750 | A1* | 11/2006 | Lu | B60C 23/061 340/440 |
| 2010/0082202 | A1* | 4/2010 | Moshchuk | B60G 17/0182 701/37 |
| 2011/0035105 | A1* | 2/2011 | Jolly | B60G 17/015 701/37 |
| 2013/0060423 | A1* | 3/2013 | Jolly | B60G 17/0152 701/38 |
| 2013/0124007 | A1* | 5/2013 | Karl | G06F 17/00 701/1 |
| 2014/0094978 | A1* | 4/2014 | Sherman | F02C 9/54 700/287 |
| 2014/0278040 | A1* | 9/2014 | Singh | G01M 17/06 701/124 |

OTHER PUBLICATIONS

LDS Dactron AN0111203, Basics of structural vibration testing and analysis, 2003.*

Ventura et al., "An Embedded System to Assess the Automotive Shock Absorber Condition Under Vehicle Operation," IEEE Sensors 2008 Conference, 2008.

* cited by examiner

SYSTEM AND METHOD FOR VEHICLE DAMPER MONITORING

TECHNICAL FIELD

The present disclosure relates generally to systems and methods for monitoring vehicle dampers. More specifically, the present disclosure relates to systems and methods for monitoring vehicle suspension dampers that can continuously evaluate damper effectiveness and provide drivers with information regarding damper failure.

BACKGROUND

Vehicle suspension dampers, or shock absorbers, are used to limit the oscillatory behavior of a vehicle's wheels or body. Over time, however, dampers can lose their effectiveness, for example, as a result of wear on the internal seals and valves of the dampers. When the damping force of a damper is reduced, the motion of the vehicle changes toward an undamped, or oscillatory motion. This undamped motion can result in, for example, increased tire wear, increased suspension wear, and overall degraded vehicle handling.

It is, therefore, advantageous for vehicle control systems, which enhance vehicle handling and increase passenger safety, to have knowledge of the effectiveness of each the vehicle's suspension dampers, and be able to provide information, for example, to the vehicle's driver regarding when a damper has failed and needs to be serviced. It may be advantageous, therefore, to provide a vehicle damper monitoring system that may utilize the dynamic motion of the vehicle's wheels to continuously monitor and evaluate the quality and/or effectiveness of each damper as the vehicle is driven, and provide feedback, for example, to a service provider or the driver if a damper is determined to be defective. It may be further advantageous to provide vehicle damper monitoring systems and methods which utilize existing vehicle sensors to measure the dynamic motion of the wheels, and monitor the effectives of the suspension dampers.

SUMMARY

In accordance with various exemplary embodiments, the present disclosure provides a system and method for monitoring vehicle dampers. In accordance with various embodiments of the present disclosure, a vehicle damper monitoring system may include at least one height sensor and at least one controller configured to receive signals from the at least one height sensor and generate a notification if the signals indicate that one or more suspension dampers of a vehicle need to be serviced.

In accordance with various additional embodiments of the present disclosure, a method for monitoring vehicle suspension dampers may include receiving signals corresponding to a height of one or more wheels of the vehicle and calculating an amplitude and a frequency for each of the one or more wheels based on the signals received for each of the one or more wheels. The method may further include generating a notification if the calculated amplitude and frequency indicate that one or more suspension dampers of the vehicle need to be serviced.

Additional objects and advantages of the disclosure will be set forth in part in the description which follows, and in part will be obvious from the description, or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

BRIEF DESCRIPTION OF THE DRAWINGS

At least some features and advantages will be apparent from the following detailed description of embodiments consistent therewith, which description should be considered with reference to the accompanying drawings, wherein.

Figure 1:
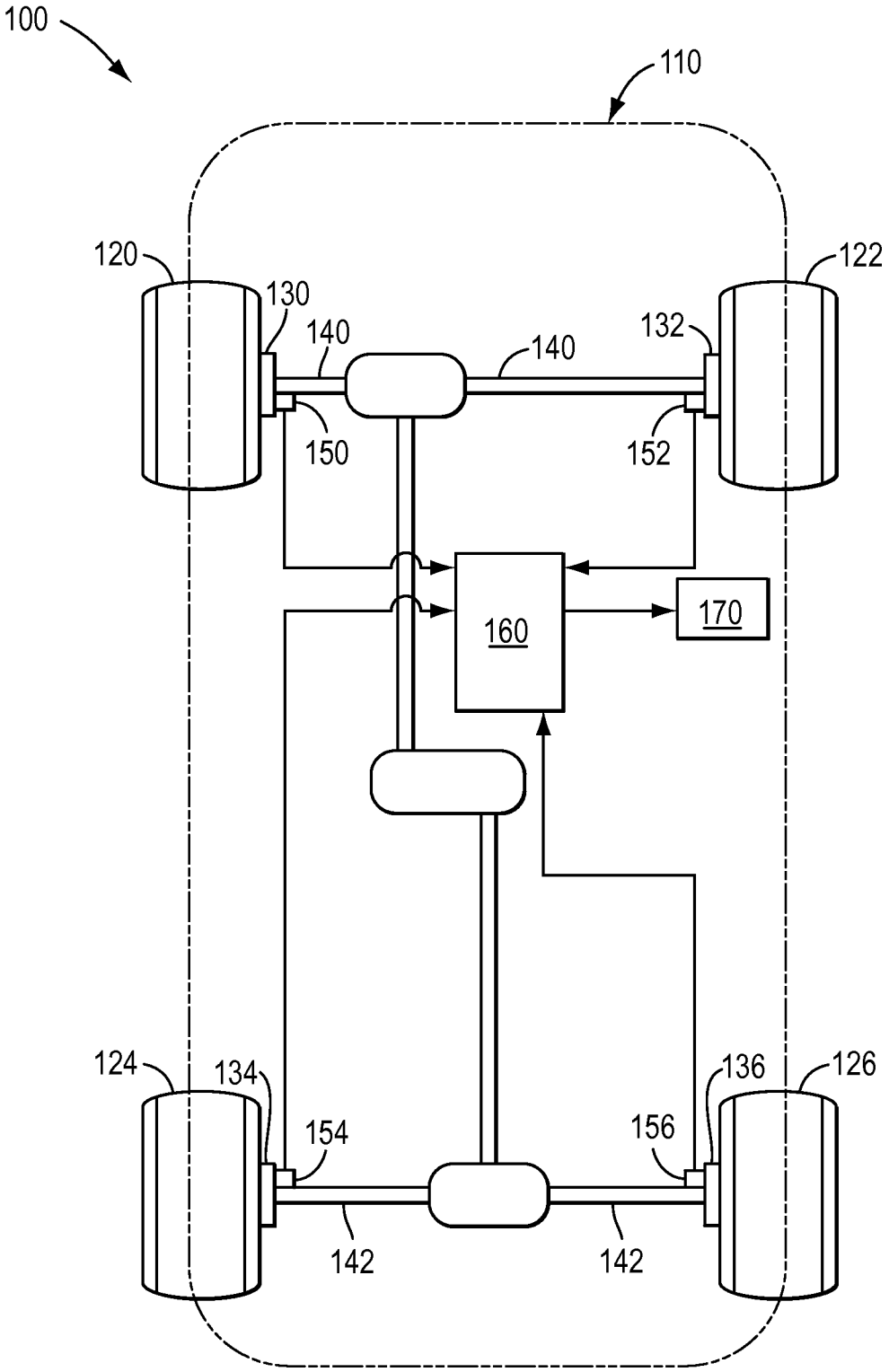
FIG. 1 is a schematic diagram illustrating an exemplary embodiment of a vehicle damper monitoring system in accordance with the present disclosure.

Although the following detailed description makes reference to illustrative embodiments, many alternatives, modifications, and variations thereof will be apparent to those skilled in the art. Accordingly, it is intended that the claimed subject matter be viewed broadly.

DESCRIPTION OF THE EMBODIMENTS

Reference will now be made in detail to various embodiments, examples of which are illustrated in the accompanying drawings. The various exemplary embodiments are not intended to limit the disclosure. To the contrary, the disclosure is intended to cover alternatives, modifications, and equivalents.

In accordance with various exemplary embodiments, the present disclosure contemplates systems and methods for monitoring vehicle suspension dampers. For instance, the embodiments described herein may utilize the dynamic motion of a vehicle's wheels to continuously monitor and evaluate the quality and/or effectiveness of each damper of the vehicle as the vehicle is driven, and provide feedback, for example, to the driver or a service provider if a damper is determined to be defective. Various embodiments described herein, for example, contemplate a vehicle damper monitoring system comprising at least one height sensor and at least one controller configured to receive signals from the at least one height sensor and generate a notification if the signals indicate that one or more suspension dampers of the vehicle need to be serviced, and methods which utilize such systems.

In various exemplary embodiments, to determine if each damper is effective in providing the necessary force to reduce oscillatory motion of the respective wheel to which it is attached, the controller is configured to calculate an amplitude and a frequency for each of the vehicle's wheels based on the signals received from a respective height sensor (associated with each wheel). In various embodiments, the controller is configured to compare the calculated amplitude for each of the wheels with a threshold amplitude, and compare the calculated frequency for each of the wheels with a body natural frequency (BNF) of the vehicle and a wheel hop natural frequency (WHNF) of the wheels. In this manner, embodiments of the present disclosure may utilize existing vehicle height sensors to continuously monitor the effectives of the suspension dampers. Embodiments of the present disclosure, however, also contemplate a system including additional sensors as needed to provide the signal inputs used in the systems and methods of the present disclosure.

As used herein, the term "body natural frequency" or "BNF" refers to the natural oscillation frequency of the body of the vehicle itself based on the mass, spring stiffness, and geometry of the body removed, for example from the rest of the vehicle components. In other words, the body natural frequency refers to the oscillation frequency that would be exhibited by the body of the vehicle if the wheels of the vehicle were, for example, attached to the ground and unable to move. In accordance with various embodiments of the present disclosure, for example, automotive vehicles, such as, for example, cars, trucks, and/or buses, generally have a body natural frequency of about 0.8 hertz to about 1.5 hertz.

As would be understood by those of ordinary skill in the art, a change in the mass of the vehicle body will necessarily result in a change in the body natural frequency of the vehicle. Thus, as used herein the term "adjusted body natural frequency" or "ABNF" refers to the adjusted natural oscillation frequency of the body of the vehicle, which accounts for the increased body mass of a vehicle that is carrying, for example, a driver, passengers, and/or cargo.

As used herein the term "wheel hop natural frequency" of "WHNF" refers to the natural frequency of wheel motion relative to the sprung mass of the vehicle (i.e., the mass of the body and other components of the vehicle that are supported by the vehicle's suspension system). In other words, the wheel hop natural frequency refers to the natural oscillation frequency of the wheels (i.e., the frequency at which the wheels will bounce up and down) based, for example, on the stiffness of the tires and springs and the unsprung weight of the suspension (i.e., the weight of the suspension components that are not supported by a spring), relative to the mass of the rest of the vehicle. In accordance with various embodiments of the present disclosure, for example, automotive vehicles, such as, for example, cars, trucks, and/or buses generally have a wheel hop natural frequency of about 9 hertz to about 15 hertz.

FIG. 1 is a schematic diagram illustrating some structural elements of an exemplary embodiment of a vehicle damper monitoring system 100 in accordance with the present disclosure. As illustrated in FIG. 1, a vehicle 110 may have wheels 120, 122, 124, and 126 with respective suspension dampers 130, 132, 134, and 136. Front wheel 120 and damper 130 are mounted on the left side of front axle 140 and front wheel 122 and damper 132 are mounted on the right side of the front axle 140. Rear wheel 124 and damper 134 are mounted on the left side of rear axle 142 and rear wheel 126 and damper 136 are mounted on the right side of the rear axle 142. The system 100 includes at least one height sensor, and at least one controller 160 that is configured to receive signals from the at least one height sensor to monitor the effectiveness of one or more of the dampers 130, 132, 134, and 136. The system 100 may further include a notification system 170 that is configured to receive a signal from the controller 160 and indicate to an observer, such as, for example, a driver of the vehicle 110 that one or more of the dampers 130, 132, 134, and 136 needs to be serviced.

In various embodiments, as illustrated in FIG. 1, the system 100 may include four height sensors 150, 152, 154, and 156, wherein each height sensor is associated with a respective wheel 120, 122, 124, and 126 and damper 130, 132, 134, and 136. As would be understood by those of ordinary skill in the art, each height sensor 150, 152, 154, and 156 is mounted with respect to each wheel 120, 122, 124, and 126 to continuously measure the relative position of each respective wheel 120, 122, 124, and 126 while the vehicle 110 is driven. In this manner, the height sensors 150, 152, 154, and 156 may measure the relative motion of each wheel 120, 122, 124, and 126 with respect to the body (not shown) of the vehicle 110.

Those of ordinary skill in the art would understand that the vehicle damper monitoring system 100 illustrated in FIG. 1 is exemplary only and intended to illustrate one embodiment of the present disclosure. Accordingly, vehicle damper monitoring systems in accordance with the present disclosure may have various types, numbers and/or configurations of wheels, dampers, controllers, and/or sensors without departing from the scope of the present disclosure and claims. For example, although the system 100 illustrated and described with reference to FIGS. 1 and 2 includes four vehicle height sensors 150, 152, 154, and 156 (one height sensor for each of the four wheels 120, 122, 124, and 126), various additional embodiments of the present disclosure contemplate a system that has only two vehicle height sensors. Various embodiments, for example, contemplate a system with two rear height sensors (i.e., a height sensor on each of the rear wheels 124 and 126), or a system with two sensors on the same side of the vehicle 110 (i.e., a height sensor on the right front wheel 122 and a height sensor on the right rear wheel 126).

Figure 2:
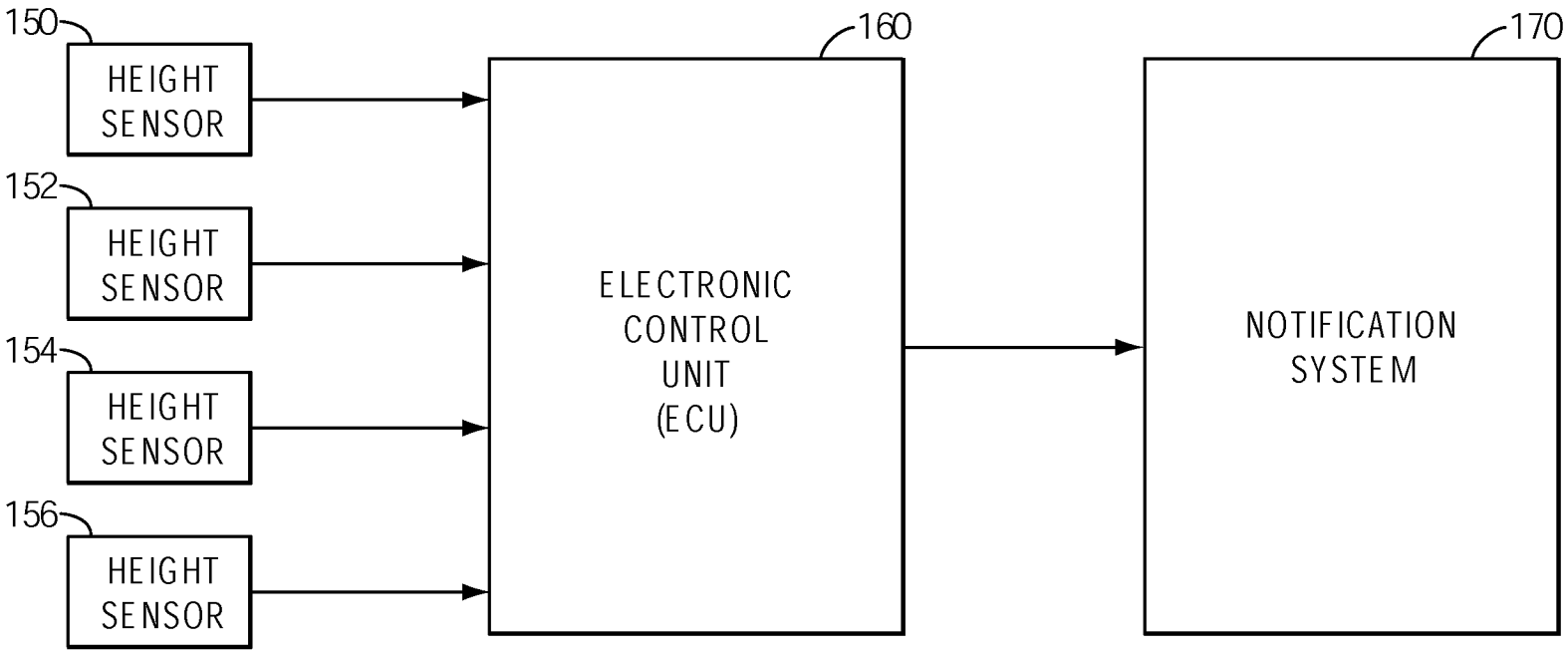
FIG. 2 is a block diagram illustrating the vehicle damper monitoring system of FIG. 1.

As illustrated in FIG. 2, the controller 160 receives signals from the height sensors 150, 152, 154, and 156 and evaluates the quality and/or effectiveness of each of the dampers 130, 132, 134, and 136 based on the signals received from the respective height sensors 150, 152, 154, and 156, as set forth in the following exemplary embodiments. The controller 160 may include, for example, an existing vehicle controller such as the Electronic Control Unit (ECU) of the vehicle 110, or a dedicated controller, or control may be distributed among more than one vehicle controller, as would be understood by one ordinarily skilled in the art.

Figure 3A:
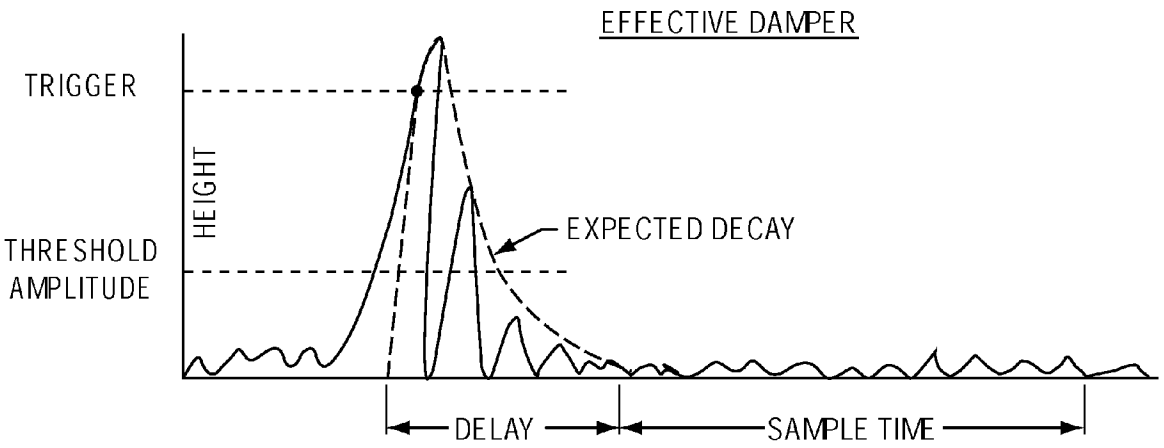
FIGS. 3A and 3B are plots illustrating exemplary height sensor signal samples in accordance with the present disclosure.
Figure 3B:
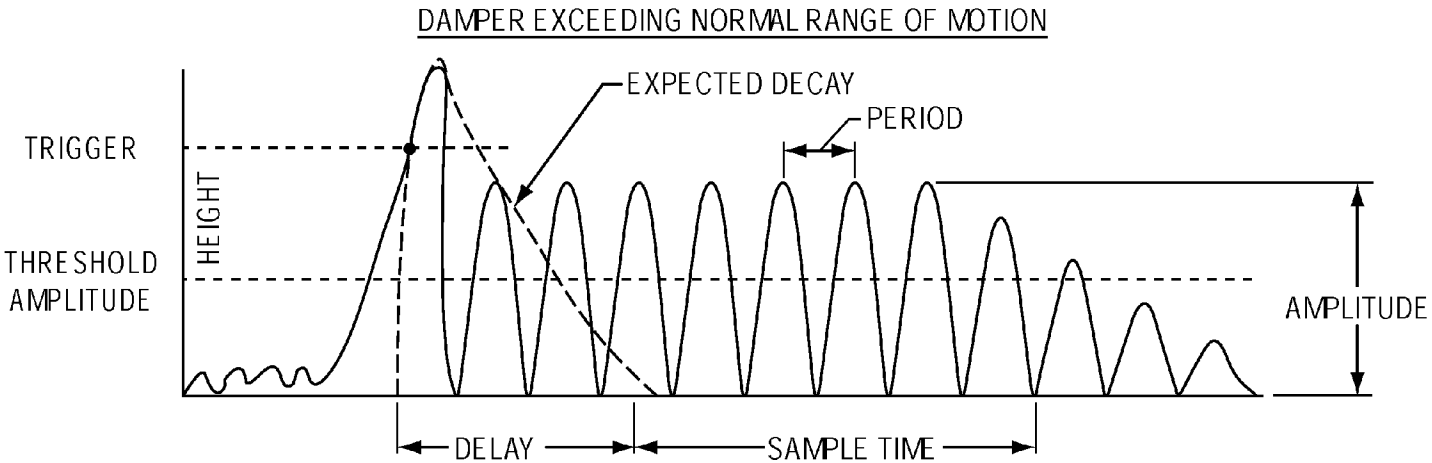

In various exemplary embodiments, the controller 160 may receive signals from the height sensors 150, 152, 154, and 156 over a specified period of time (e.g., a sample time), such as, for example, over a 2 second period of time, and calculate an amplitude and a frequency for each of the wheels 120, 122, 124, and 126 based on an average of the signals received during that time period. In various embodiments, for example, as illustrated with reference to FIGS. 3A and 3B, the controller 160 may be configured to receive signals from the height sensors 150, 152, 154, and 156 until the height (measured from each sensor) exceeds a threshold value (e.g., a trigger), indicating, for example, an oscillatory event. After a delay time (i.e., to allow for damping of the oscillation and an expected decay in the amplitude), the controller 160 may then receive signals from the height sensors 150, 152, 154, and 156 over the specified sample time, and calculate an amplitude and a frequency for each of the wheels 120, 122, 124, and 126 based on an average of the signals received during the sample time. FIGS. 3A and 3B, for example, are plots illustrating exemplary height sensor signal samples for an effective damper and a damper that is exceeding its normal range of motion (wherein the average sampled amplitude exceeds a threshold amplitude).

In various embodiments of the present disclosure, the controller 160 may calculate the amplitude and frequency for each of the wheels 120, 122, 124, and 126 using a Discrete Fourier Transform to process the height signals from the height sensors 150, 152, 154, and 156 (i.e., received over the specified sample time), as would be understood by those of ordinary skill in the art.

To determine whether or not one or more of the dampers 130, 132, 134, and 136 is defective, in various embodiments, the controller 160 may first compare the calculated amplitude for each of the wheels 120, 122, 124, and 126 with a predefined threshold amplitude. In various embodiments, for example, the controller 160 is programmed with an acceptable amplitude range for the wheels 120, 122, 124, and 126, such as, for example, an amplitude range of about 1.5 volts to about 3.5 volts. If the calculated amplitude for any of the wheels 120, 122, 124, and 126 is outside this range (i.e., if the calculated amplitude is greater than about 3.5 volts or is less than about 1.5 volts), then the controller may tag the wheel, for example, with an "A" (for amplitude) to indicate that its respective damper is exceeding the normal range of motion. In various embodiments, for example, a memory (not shown) associated with the controller 160 may store a value that indicates that the calculated amplitude for a wheel is outside of the acceptable amplitude range.

In various exemplary embodiments, the controller 160 may then compare the calculated frequency for each of the wheels 120, 122, 124, and 126 with a body natural frequency of the vehicle 110 and a wheel hop natural frequency of the wheels 120, 122, 124, and 126. As would be understood by those of ordinary skill in the art, as above, the body natural frequency and the wheel hop natural frequency are frequencies that are specific to an individual vehicle 110 and each wheel 120, 122, 124, and 126 of the vehicle 110. As such, these frequencies may be predetermined and programmed into the controller 160. If the calculated frequency for any of the wheels 120, 122, 124, and 126 is within a specified percentage of either the body natural frequency or the wheel hop natural frequency (e.g., indicating that the calculated frequency is close to the BNF or WHNF), then the controller 160 may also tag the wheel. In various embodiments, for example, if the calculated frequency is within 20% of either the BNF or the WHNF, the controller 160 may tag the wheel, for example, with an "F" (for frequency) to indicate that its respective damper may be defective. As above, in various embodiments, a memory (not shown) associated with the controller 160 may store a value that indicates that the calculated frequency for a wheel is close to the BNF or WHNF.

In various additional embodiments, the system 100 may also account for a mass increase of the vehicle 110 due to, for example, the weight of the driver, passengers, and/or cargo in the vehicle 110. In various embodiments, for example, as would be understood by one of ordinary skill in the art, the controller 160 may calculate an adjusted body natural frequency of the vehicle 110 based on the signals received from the height sensors 150, 152, 154, and 156. The controller 160 may then compare the calculated frequency of each wheel 120, 122, 124, and 126 with the adjusted body natural frequency of the vehicle 110 (i.e., instead of the BNF) to determine if the calculated frequency of the wheel is within, for example, 20%, of the ABNF.

If both the calculated amplitude and frequency of any of the wheels 120, 122, 124, and 126 indicates that its respective damper 130, 132, 134, and 136 may be defective (i.e., if the wheel is tagged with both "A" and "F"), the controller will flag the wheel and increase a count for that wheel. In other words, during each damper check cycle, the controller 160 will look at each wheel 120, 122, 124, and 126 and will flag a wheel when the calculated amplitude of the wheel falls outside the acceptable range and the calculated frequency of the wheel is within the specified percentage of the BNF (or ABNF) or the WHNF. The controller may then increase a count for each of the wheels 120, 122, 124, and 126 that is flagged (i.e., indicating that the wheel's damper may be defective) and decrease a count for each of the wheels 120, 122, 124, and 126 that is not flagged (i.e., indicating that that the wheel's damper is currently functioning). In this manner, as the vehicle 110 is driven, the controller 160 may keep a running tally of counts for each of the wheels 120, 122, 124, and 126.

As would be understood by one of ordinary skill in the art, for example, the controller 160 continuously makes the above determination for each of the wheels 120, 122, 124, and 126 based on the signals received from the height sensors 150, 152, 154, and 156 as the vehicle 110 is driven. In this manner, the controller 160 is configured to make this determination (i.e., run through the above damper check cycle) continuously during each new drive cycle of the vehicle 110 and update the count for each wheel 120, 122, 124, and 126 accordingly. Thus, in various embodiments, the controller 160 may first confirm that the vehicle 110 is entering a new drive cycle (e.g., as opposed to merely idling and/or being repositioned) prior to entering a new damper check cycle. In various embodiments, for example, the controller 160 may check whether the vehicle's speed is greater than about 10 miles per hour before entering a new damper check cycle. In various additional embodiments, to prevent the wheel counts from being updated too frequently during each drive cycle, the controller 160 may be configured to run a new damper check cycle (and update the count for each wheel 120, 122, 124, and 126) after every mile that the vehicle 110 is driven.

In various embodiments, the controller 160 generates a notification when the count for one or more of the wheels 120, 122, 124, and 126 exceeds a specified value. In various embodiments, for example, the controller 160 may generate the notification when the count for a wheel exceeds a specified count limit of about 100 to about 300 counts. In other words, when the count for any of the wheels 120, 122, 124, and 126 exceeds the specified count limit, it is determined that the damper associated with that wheel has failed and a notification is generated.

In various exemplary embodiments of the present disclosure, the controller 160 sends a notification to a notification system 170 when the count for one or more of the wheels 120, 122, 124, and 126 exceeds the specified count limit, and the notification system 170 alerts a driver of the vehicle 110 that one or more of the dampers 130, 132, 134, and 136 needs to be serviced. The notification system 170 can, for example, audibly and/or visually indicate to the driver that one or more of the dampers 130, 132, 134, and 136 needs to be checked and/or serviced. As would be understood by those of ordinary skill in the art, the notification system 170 can include, for example, an indicator light or LCD that is displayed on the vehicle's console, rearview mirror, or other location noticeable to a driver. The indicator light or LCD can be, for example, constant or blinking, can be displayed only at startup or displayed continuously throughout the vehicle's use, and can be accompanied by a sound to further aid in alerting the driver to the damper condition. The present disclosure further contemplates a notification system 170 that also or alternatively alerts a dealer or mechanic that one or more of the dampers need to be checked and/or serviced, such as, for example, by storing a diagnostic trouble code that is accessed at the time of service and/or by transmitting a trouble code to a dealer or mechanic prior to the time of service. With this information, the service provider can contact the vehicle's owner regarding the need for service, or suggest that the dampers be inspected the next time the vehicle is in for service. The notification system 170 can be, for example, wireless within the vehicle and/or between the vehicle and the service provider.

Figure 4:
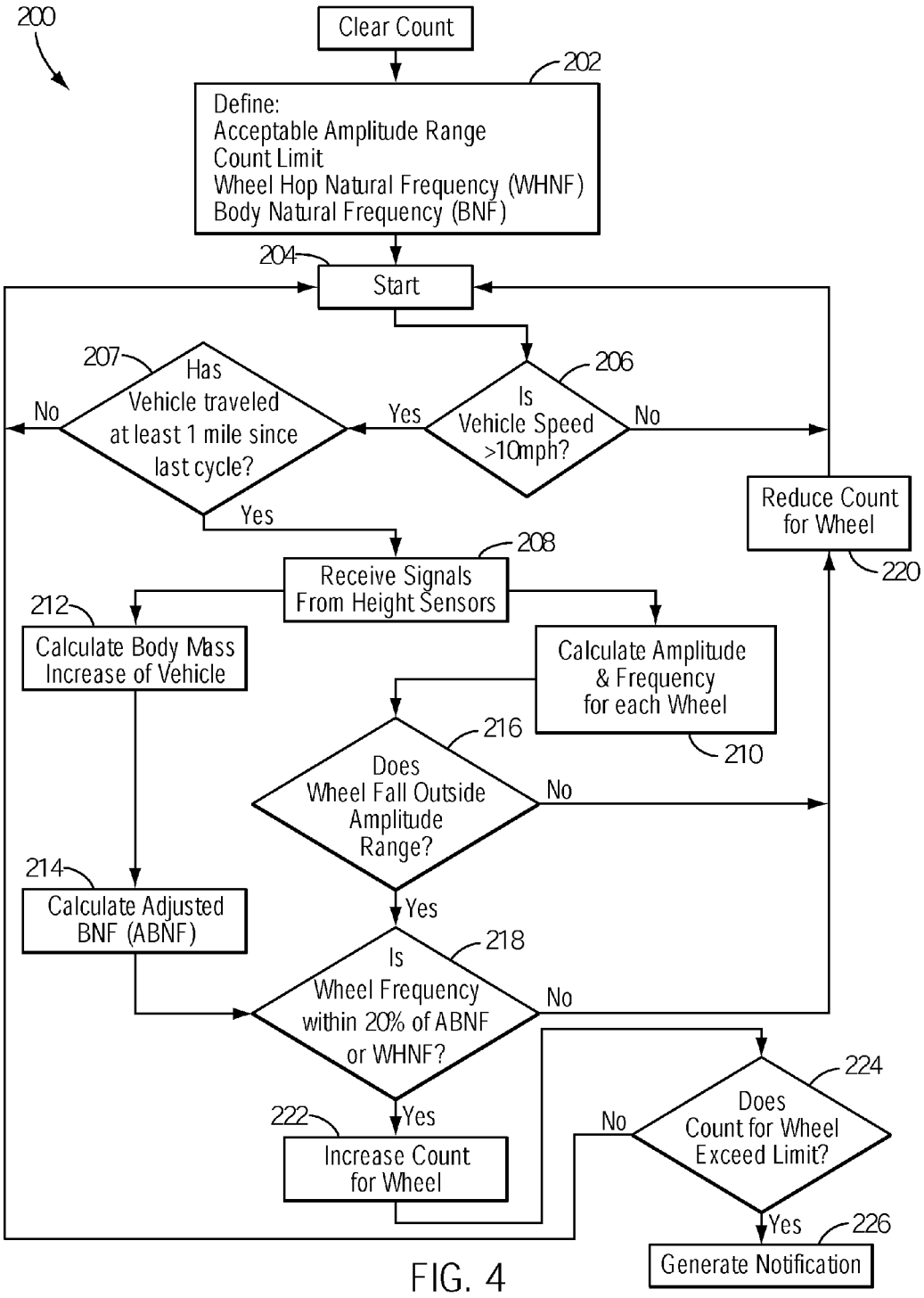
FIG. 4 is a flow chart illustrating an exemplary embodiment of a method for monitoring vehicle dampers in accordance with the present disclosure.

FIG. 4 shows a flow diagram depicting an exemplary embodiment of a method 200 of monitoring vehicle dampers in accordance with the present disclosure. As illustrated in FIG. 4, before initiating a cycle of the method 200, all current counts are cleared and an amplitude range, count limit, wheel hop natural frequency (WHNF), and body natural frequency (BNF) are defined as shown in step 202. In step 204, the method of monitoring vehicle dampers using, for example, the above described system 100 begins.

In various embodiments, as shown in step 206, the controller 160 may first confirm that the vehicle 110 is entering a new drive cycle, for example, by determining whether or not the vehicle's speed is greater than about 10 mph. If the vehicle is entering a new drive cycle, in step 208, the controller 160 receives signals corresponding to a height of one or more wheels (e.g., from height sensors 150, 152, 154, and 156). In various embodiments, as above, the controller 160 receives signals from the height sensors 150, 152, 154, and 156 until the height (measured from each sensor) exceeds a trigger. After a delay time, the controller 160 again receives signals from the height sensors 150, 152, 154, and 156 for a specified sample time.

As above, in various embodiments, the controller 160 may receive signals corresponding to a height of a right front wheel 122, a height of a left front wheel 120, a height of a right rear wheel 126, and a height of a left rear wheel 124. In various additional embodiments, the controller 160 may only receive signals corresponding to the height of the right rear wheel 126 and the height of the left rear wheel 124.

In step 210, the controller 160 calculates an amplitude and frequency for each of the one or more wheels 120, 122, 124, and 126 based on the signals received for the one or more wheels, for example, based on the signals received for the one or more wheels during the specified sample time. The controller 160 may then compare the calculated amplitude for each of the one or more wheels 120, 122, 124, and 126 with the predefined amplitude range. In various embodiments, for example, as shown in step 216, the controller 160 makes a determination for each wheel whether or not the calculated amplitude for the wheel falls outside the amplitude range. If not, as shown in step 220, the controller reduces a count for the wheel (i.e., each wheel that did not exceed the threshold amplitude) to indicate that the damper associated with the wheel appears to be currently functioning. If yes, the controller 160 goes on to compare the calculated frequency for the wheel (i.e., each wheel that fell outside the amplitude range) with the predefined BNF and WHNF.

In various exemplary embodiments, as shown in steps 212 and 214, the controller 160 may also calculate a body mass increase of the vehicle 110 (i.e., to account for the weight of any occupants and/or cargo) based on the signals received from the height sensors 150, 152, 154, and 156, and calculate an adjusted body natural frequency (ABNF). Accordingly, as shown in step 218, in various embodiments the controller 160 makes a determination for each wheel (i.e. each wheel that fell outside the amplitude range) whether or not the calculated frequency for the wheel is within a specified percentage of either the ABNF or WHNF, such as, for example, within 20% of either the ABNF or WHNF. If not, as above, the controller 160 reduces a count for the wheel as shown in step 220. If yes, the controller 160 increases the count for the wheel as shown in step 222. In step 224, the controller 160 makes a determination for each wheel (i.e. each wheel that is within the specified percentage) whether or not the count for the wheel exceeds a specified value (i.e., the defined count limit). If not, the method returns to the beginning, and will start again at step 204.

Figure 5:
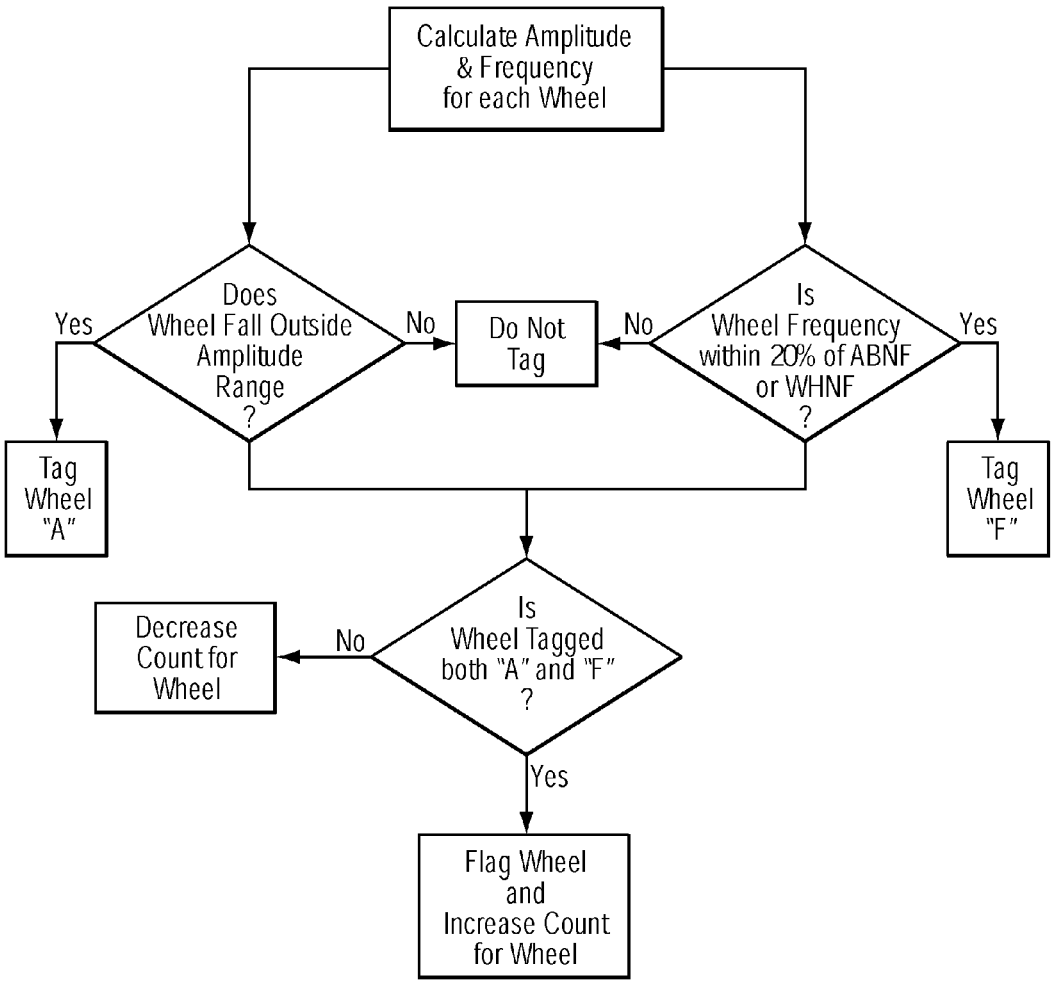
FIG. 5 is a flow chart illustrating another exemplary embodiment of a method for monitoring vehicle dampers in accordance with the present disclosure.

As above, in various additional exemplary embodiments, as shown in FIG. 5, the controller 160 may, for example, tag each wheel that fell outside the amplitude range (e.g., with an "A") and a memory (not shown) associated with the controller 160 may store a value that indicates that the calculated amplitude for the wheel is outside the range and that the wheel needs further investigation. As further illustrated in FIG. 5, the controller 160 may also tag each wheel that is within the specified percentage of either the ABNF or WHNF (e.g., with a "F") and a memory associated with the controller 160 may store a value that indicates that the calculated frequency for the wheel is close to the BNF or WHNF (which indicates that the damper associated with the wheel is likely defective). In this manner, as above, the controller 160 may flag a wheel that is tagged with both an "A" and "F," and may increase a count for each wheel that is flagged and decrease a count for each will that is not flagged. Those of ordinary skill in the art would understand that such tags (e.g., "A" and "F") and flags may be cleared from the memory at the start of each method cycle.

In various embodiments, to prevent the method from cycling too frequently during a single drive cycle (i.e., during a single period in which the vehicle is started and turned off), as shown in step 207, the controller 160 may also confirm that the vehicle 110 has traveled at least a specified mileage, such as, for example, at least 1 mile before cycling again. Accordingly, regardless as to whether or not the count for a given wheel is increased or decreased, a new cycle may be prevented (e.g., for that wheel) for the specified mileage. In other words, in various embodiments, a count for each of the one or more wheels 120, 122, 124, and 126 is adjusted once about every 1 mile (i.e., the count is either increased or decreased only once every mile that the vehicle 110 is driven).

If the count for a wheel exceeds the count limit, as shown in step 226, the controller 160 generates a notification, for example, by having the notification system 170 send a notification indicating that the suspension damper associated with the wheel needs to be serviced. In various embodiments, for example, the controller 160 may provide feedback to a vehicle driver, dealer, and/or other service provider when the count for one or more of the wheels 120, 122, 124, and 126 exceeds the specified value. In various additional embodiments, the controller 160 may store a diagnostic trouble code when the count for one or more of the wheels 120, 122, 124, and 126 exceeds the specified value, and that trouble code may be accessed by a dealer and/or other service provider.

Those of ordinary skill in the art would understand that the method 200 illustrated in the embodiment of FIG. 4 is exemplary only and intended to illustrate one embodiment of a method for monitoring vehicle dampers. Accordingly, methods in accordance with the present disclosure may have various numbers and/or arrangements of steps which utilize the signals corresponding to a height of one or more wheels of a vehicle to monitor the vehicle's suspension dampers without departing from the scope of the present disclosure and claims.

Figure 6:
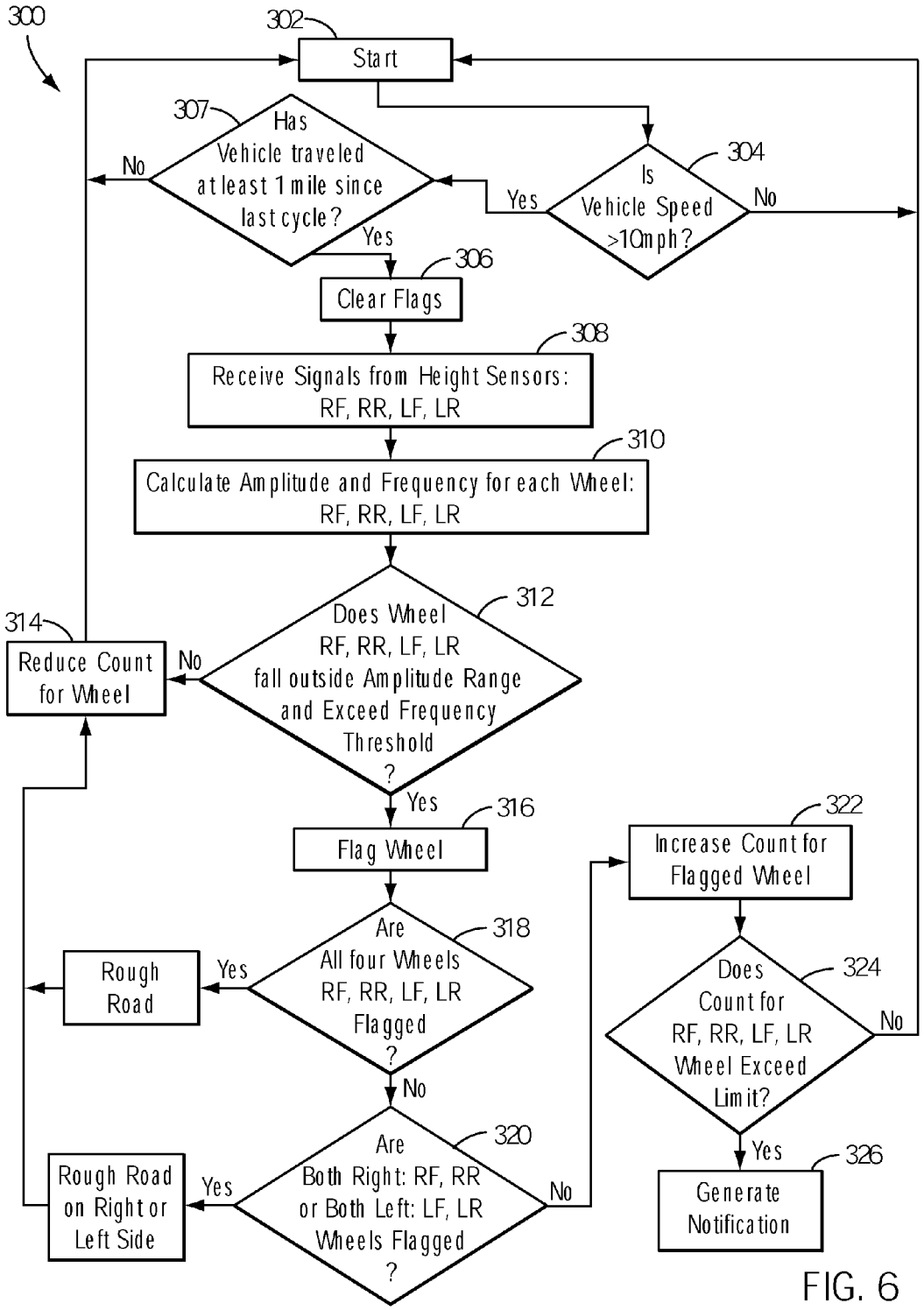
FIG. 6 is a flow chart illustrating yet another exemplary embodiment of a method for monitoring vehicle dampers in accordance the present disclosure.

FIG. 6, for example, shows a flow diagram depicting another exemplary embodiment of a method 300 of monitoring vehicle dampers for a vehicle having four height sensors (i.e., one height sensor for each wheel) in accordance with the present disclosure. Although not shown, before initiating a cycle of the method 300, all current counts are cleared and an amplitude threshold, a frequency threshold, and a count limit are defined. In step 302, the method of monitoring vehicle dampers using, for example, the above described system 100 begins.

In various embodiments, as shown in step 304, the controller 160 may first confirm that the vehicle 110 is entering a new drive cycle, for example, by determining whether or not the vehicle's speed is greater than about 10 mph. If the vehicle is entering a new drive cycle, in step 306, all flags are cleared, and in step 308, the controller 160 receives signals corresponding to a height of each of the wheels 120, 122, 124, and 126 (e.g., from height sensors 150, 152, 154, and 156). In various embodiments, as above, the controller 160 receives signals from the height sensors 150, 152, 154, and 156 until the height (measured from each sensor) exceeds a trigger. After a delay time, the controller 160 again receives signals from the height sensors 150, 152, 154, and 156 for a specified sample time.

In step 310, the controller 160 calculates an amplitude and frequency for each of the wheels 120, 122, 124, and 126 based on the signals received for the wheels, for example, based on the signals received for the wheels during the specified sample time. The controller 160 may then compare the calculated amplitude for each of the wheels 120, 122, 124, and 126 with the predefined amplitude threshold and compare the calculated frequency for each of the wheels 120, 122, 124, and 126 with the predefined frequency threshold. In various embodiments, for example, as shown in step 312, the controller 160 makes a determination for each wheel whether or not the calculated amplitude for the wheel exceeds the amplitude threshold and whether or not the calculated frequency for the wheel exceeds the frequency threshold. If not, as shown in step 314, the controller reduces a count for the wheel (i.e., each wheel that did not exceed its respective thresholds). If yes, as shown in step 316, the controller 160 flags the wheel (i.e., each wheel that exceeded its respective thresholds).

To distinguish whether or not the discrepancies are due to actual damper failure or due to road conditions, the controller may compare the wheels of the vehicle with each other. As shown in step 318, for example, the controller 160 may compare all four wheels (i.e., right front (RF), right rear, (RR), left front (LF), and left rear (LR)) with each other and make a determination whether or not all four of the wheels are flagged. If yes, then it is determined that the vehicle 110 is driving on a rough road, and the controller 160 reduces a count for the flagged wheel(s) as shown in step 314.

If not, as shown in step 320, the controller 160 goes onto to compare the wheels on each side of the vehicle 110 with each other and make a determination whether or not both the right (i.e. RF and RR) or both the left (i.e., LF and LR) wheels of the vehicle 110 are flagged. If yes, then it is determined that the vehicle 110 is driving on a road that is either rough on the right side or rough on the left side, and the controller 160 reduces a count for the flagged wheel as shown in step 314. If not, the controller determines that the discrepancy is likely due to damper failure and increases a count for the flagged wheel as shown in step 322.

In step 324, the controller 160 makes a determination for each flagged wheel (i.e. each flagged wheel with an increased count) whether or not the count for the wheel exceeds a specified value (i.e., the defined count limit). If not, the method returns to the beginning, and will start again at step 302. If the count for a flagged wheel exceeds the count limit, as shown in step 326, the controller 160 generates a notification, for example, by having the notification system 170 send a notification indicating that the suspension damper associated with the wheel needs to be serviced.

As above, in various embodiments, to prevent the method from cycling too frequently during a single drive cycle, as shown in step 307, the controller 160 may confirm that the vehicle 110 has traveled at least a specified mileage, such as, for example, at least 1 mile before cycling again. Accordingly, in various embodiments, a count for each of the one or more wheels 120, 122, 124, and 126 is adjusted once about every mile (i.e., the count is either increased or decreased only once every mile that the vehicle 110 is driven).

While the present disclosure has been disclosed in terms of exemplary embodiments in order to facilitate better understanding of the disclosure, it should be appreciated that the disclosure can be embodied in various ways without departing from the principle of the disclosure. Therefore, the disclosure should be understood to include all possible embodiments which can be embodied without departing from the principle of the disclosure set out in the appended claims. The present teachings as disclosed work equally well for front, rear, and four-wheel drive vehicles, being independent of vehicle drive type. Furthermore, although the present disclosure has been discussed with relation to automotive vehicles, for example, having four wheels, those of ordinary skill in the art would understand that the present teachings as disclosed would work equally well for any type of vehicle having one or more height sensors associated with the wheels of the vehicle.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the written description and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "a sensor" includes two or more different sensors. As used herein, the term "include" and its grammatical variants are intended to be non-limiting, such that recitation of items in a list is not to the exclusion of other like items that can be substituted or added to the listed items.

It will be apparent to those skilled in the art that various modifications and variations can be made to the system and method of the present disclosure without departing from the scope its teachings. Other embodiments of the disclosure will be apparent to those skilled in the art from consideration of the specification and practice of the teachings disclosed herein. It is intended that the specification and embodiment described herein be considered as exemplary only.

What is claimed is:

1. A vehicle damper monitoring system, comprising:

at least one height sensor; and at least one controller configured to receive signals from the at least one height sensor and generate a notification if the signals indicate that one or more suspension dampers of a vehicle need to be serviced, wherein the controller is configured to calculate an amplitude and a frequency of an oscillatory motion of one or more wheels of the vehicle based on the signals received from the at least one height sensor, and wherein the controller is configured to generate the notification if the amplitude of the oscillatory motion of the one or more wheels of the vehicle exceeds an expected amplitude over a predetermined time period following a decay time of an oscillatory event.

2. The vehicle damper monitoring system of claim 1, wherein the controller is configured to calculate the amplitude and the frequency when the signals received from the at least one height sensor exceed a threshold value, the controller being configured to calculate the amplitude and the frequency after a specified delay time to account for an expected decay in the amplitude of the one or more wheels after the signals exceed the threshold value.

3. The vehicle damper monitoring system of claim 1, wherein the controller is configured to compare the calculated amplitude for each of the one or more wheels with an acceptable amplitude range.

4. The vehicle damper monitoring system of claim 3, wherein the controller is configured to compare the calculated frequency for each of the one or more wheels with a threshold frequency.

5. The vehicle damper monitoring system of claim 4, wherein the controller is configured to flag a wheel when the calculated amplitude falls outside the acceptable amplitude range and the calculated frequency of the wheel exceeds the threshold frequency.

6. The vehicle damper monitoring system of claim 3, wherein the controller is configured to compare the calculated frequency for each of the one or more wheels with a body natural frequency of the vehicle and a wheel hop natural frequency of the wheels.

7. The vehicle damper monitoring system of claim 6, wherein the controller is configured to flag a wheel when the calculated amplitude of the wheel exceeds the threshold amplitude and the calculated frequency of the wheel is within a specified percentage of either the body natural frequency or the wheel hop natural frequency.

8. The vehicle damper monitoring system of claim 7, wherein the specified percentage is about 20 percent.

9. The vehicle damper monitoring system of claim 7, wherein the controller is configured to increase a count for each of the one or more wheels that is flagged and to decrease a count for each of the one or more wheels that is not flagged.

10. The vehicle damper monitoring system of claim 9, wherein the controller is configured to generate the notification when the count for one or more of the wheels exceeds a specified value.

11. The vehicle damper monitoring system of claim 1, wherein generating the notification comprises storing a diagnostic trouble code.

12. The vehicle damper monitoring system of claim 1, further comprising a notification system configured to receive a signal from the controller and indicate that one or more of the suspension dampers need to be serviced.

13. A method for monitoring vehicle suspension dampers, comprising:

receiving signals corresponding to a height of one or more vehicle wheels;

calculating amplitude and frequency of an oscillatory motion of each of the one or more wheels based on the signals received for each of the one or more wheels;

comparing the frequency of the oscillatory motion of each of the one or more wheels to at least one of a body natural frequency and a wheel hop natural frequency; and generating a notification if the calculated frequency is within a predetermined range of the body natural frequency or the wheel hop natural frequency.

14. The method of claim 13, wherein receiving signals corresponding to a height of one or more wheels comprises receiving signals corresponding to a height of a right front wheel, a height of a left front wheel, a height of a right rear wheel, and a height of a left rear wheel.

15. The method of claim 13, wherein receiving signals corresponding to a height of one or more wheels comprises receiving signals corresponding to a height of a right rear wheel and a height of a left rear wheel.

16. The method of claim 13, further comprising comparing the calculated amplitude for each of the one or more wheels with an acceptable amplitude range.

17. The method of claim 16, further comprising calculating an adjusted body natural frequency of the vehicle based on the signals received for each of the one or more wheels.

18. The method of claim 17, wherein comparing the calculated frequency with the body natural frequency comprises comparing the calculated frequency with the adjusted body natural frequency.

19. The method of claim 16, further comprising adjusting a count for each of the one or more wheels based on the comparing of the calculated amplitude and the comparing of the calculated frequency.

20. The method of claim 19, wherein generating a notification comprises providing feedback to a vehicle driver when the count for one or more of the wheels exceeds a specified value.

21. The method of claim 19, wherein generating a notification comprises storing a diagnostic trouble code when the count for one or more of the wheels exceeds a specified value.

22. A vehicle damper monitoring system, comprising:

at least one height sensor; and at least one controller configured to receive signals from the at least one height sensor and generate a notification if the signals indicate that one or more suspension dampers of a vehicle need to be serviced, wherein the controller is configured to calculate an amplitude and a frequency of an oscillatory motion of one or more wheels of the vehicle based on the signals received from the at least one height sensor, wherein the controller is configured to compare the calculated amplitude for each of the one or more wheels with an acceptable amplitude range, and wherein the controller is configured to compare the calculated frequency for each of the one or more wheels with a body natural frequency of the vehicle and a wheel hop natural frequency of the wheels and to generate the notification if the calculated frequency is within a predetermined range of one or both of the body natural frequency and the wheel hop natural frequency.

* * * * *